US005575625A

United States Patent [19]

Castel

[11] Patent Number: 5,575,625

[45] Date of Patent: Nov. 19, 1996

[54] MULTIPHASE PUMP WITH SEQUENTIAL JETS

[75] Inventor: Yvon Castel, Croissy sur Seine, France

[73] Assignee: Institut Francais du Petrole, Rueil Malmaison, France

[21] Appl. No.: 498,054

[22] Filed: Jul. 5, 1995

[30] Foreign Application Priority Data

Jul. 5, 1994 [FR] France ..... 94 08381

[51] Int. Cl.[6] ..... F04F 5/24; F04F 5/46

[52] U.S. Cl. ..... 417/178

[58] Field of Search ..... 417/178, 194

[56] References Cited

U.S. PATENT DOCUMENTS

| | | | |
|---|---|---|---|
| 2,623,474 | 12/1952 | Friedman | 417/178 |
| 3,046,732 | 7/1962 | Foa . | |
| 3,450,051 | 6/1969 | Anton | 417/178 X |
| 4,485,518 | 12/1984 | Kasper . | |
| 4,865,518 | 9/1989 | Foa . | |
| 5,088,896 | 2/1992 | Nielsen et al. | 417/178 |

FOREIGN PATENT DOCUMENTS

| | | | |
|---|---|---|---|
| 1200145 | 12/1959 | France . | |
| 1521928 | 11/1989 | U.S.S.R. | 417/178 |
| 197684 | 3/1924 | United Kingdom . | |
| 2205359 | 12/1988 | United Kingdom . | |

*Primary Examiner*—Richard E. Gluck
*Attorney, Agent, or Firm*—Antonelli, Terry, Stout & Kraus

[57] ABSTRACT

Pumping device for effecting direct energy exchange between a drive fluid and a primary fluid. The device has, in combination, a hollow static part allowing the drive fluid to pass, which static hollow part has at least one orifice and a distributing part having at least one opening the distributing part is located relative to the static hollow part to allow the drive fluid to pass from an orifice to an orifice, the distributing parts and the static part are joined by a connecting and sealing part, and a movable part is disposed in the space formed by the static hollow part, the distributing part, and the connecting part. The movable part has at least one means allowing orifices to be blocked, so that at least part of said drive fluid is ejected toward the primary fluid when the movable part rotates.

12 Claims, 4 Drawing Sheets

MULTIPHASE PUMP WITH SEQUENTIAL JETS

Figure 1:
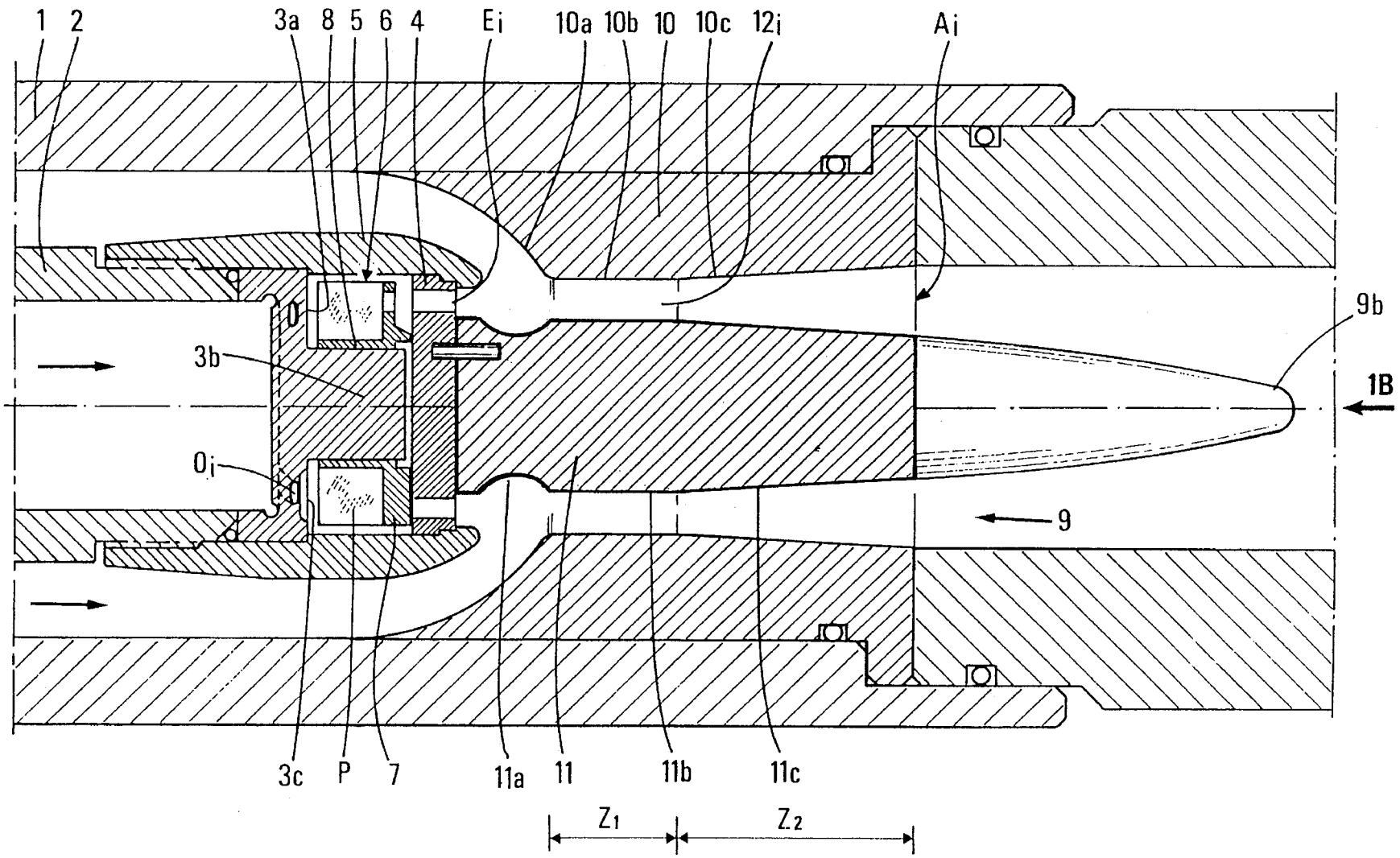

The present invention relates to a device for enhancing the pumping and thrust performance of devices in which a drive fluid is induced in a primary fluid to be transported so as to transfer a certain quantity of energy to the latter.

The device according to the invention is particularly suitable for pumping a fluid containing impurities such as solid particles such as sand or hydrates.

Direct transfer of energy from a first fluid to a second fluid to be transported is described in the prior art.

U.S. Pat. No. 3,046,732, U.S. Pat. No. 4,485,518, and U.S. Pat. No. 4,865,518 describe devices and methods employing this principle.

The teaching contained in U.S. Pat. No. 4,485,518 has the principal goal of minimizing shear effects created in the primary fluid to be pumped that may appear at the interfaces between the fluid and the mechanical parts of the device. For this purpose, the invention consists of separating the drive fluid into two parts, ejecting a first part of this fluid through orifices located on a rotor into a primary fluid, and using the fluid jet resulting from the second part of the drive fluid passing through a central orifice to drive the first part of the drive fluid and the primary fluid. Thus, the shear that might appear between a fluid and a mechanical part is minimized. However, in such a type of device, the roller bearings allowing rotation of the rotor are in contact with the primary fluid which may contain impurities. The problems generated by contact between particles and the mechanical parts of the device may lead to decreased reliability of the device and more frequent servicing to replace parts.

U.S. Pat. No. 4,485,518 teaches ejecting a drive fluid in the form of jets through orifices and grooves located on the outside wall of a rotating part, said part being positioned inside a pipe in which a primary fluid to be pumped circulates. The drive fluid jets emerging when this part rotates transfer their energy tangentially to the primary fluid.

In the documents referred to above, the mechanical parts that are in rotation are in direct contact with the primary fluid to be pumped which can contain impurities such as solid particles, sand, hydrates, or any other type of particles.

The presence of these impurities may generate problems, particularly mechanical problems, seizing of these parts, and increased wear.

The problems referred to above decrease the operating reliability of the device and the lifetime of the parts, leading to shorter servicing intervals for the device.

The goal of the present invention is to palliate these drawbacks and particularly to increase pumping efficiency, using transfer of energy from one fluid to another fluid. For example, it allows the lifetime of parts that rotate with respect to each other to be increased by removing them from contact with the impurities included in the fluid to be pumped.

The present invention relates to a simple, sturdy, and reliable machine for transferring fluid such as a viscous fluid that is difficult to entrain or which by its nature requires substantial forces and energies to cause the various parts to rotate with respect to each other.

It is advantageous applied in the petroleum production industry for transferring petroleum effluents such as heavy crudes, gasified and laden with solid particles such as sand or hydrates. It is more suitable for viscous, gasified fluids or products containing abrasive or corrosive particles such as $H_2S$, $CO_2$, and brines encountered in most oil-type effluents.

Advantageously, the device according to the present invention is particularly suitable for operating offshore wells and proves to be easier than the sea-bed electric pumping technique currently employed.

It advantageously replaces the sea-bed pumps normally used for operating horizontal wells, which often silt up with sand.

The present invention is based in particular on a chosen arrangement of static and movable parts so that the primary fluid to be pumped does not come in contact with the movable parts of the device.

The present invention relates to a pumping device employing direct energy exchange between a drive fluid and a primary fluid having, in combination, a static hollow part allowing said drive fluid to pass, said static hollow part having at at least one of its ends at least one orifice Oi, a distributing part having at least one orifice Ei, said distributing part being situated with respect to the static hollow part such as to allow the drive fluid to pass from an orifice Oi to an orifice Ei, the distributing part and the static part being joined to each other by a connecting and sealing part, a movable part disposed in the space formed by the static hollow part, the distributing part, and the connecting part, said movable part having at least one means for blocking orifices Ei such that at least part of said drive fluid is ejected sequentially to the primary fluid when the movable part rotates.

The movable part can be a turbine made to rotate by the drive fluid.

The number of orifices Oi located on the static hollow part can be equal to the number of orifices Ei located on the distributing part.

The device may have a part located for example in the extension of the distributing part and aligned with the latter with the aid of means, the part having at least one opening creating a mixing space.

The movable part is for example an action turbine or a reaction turbine caused to rotate by the drive fluid.

The movable part is for example a reaction turbine, and it is caused to rotate by jets of fluid passing through orifices.

The orifices of the distributing part can be composed of a single circular slot and the blocking means of the slot can be composed of a slide designed to allow passage of the drive fluid jets over a given width.

The distributing part is for example extended by a part whose shape is designed to create one or more mixing spaces.

The pumped fluid can be a multiphase fluid that may contain solid particles and/or a petroleum fluid and/or a fluid with a high viscosity.

Minimizing the number of mechanical parts normally used in classical pumping devices, particularly by replacing the mechanical blades of positive displacement pumps or rotodynamic pumps by fluid or liquid blades and placing the movable parts in contact with an impurity-free fluid increases the reliability of the device.

The sequencing system of the device offers in particular the following advantage: no movable parts are in contact with the pumped effluents that have varying degrees of aggressiveness. In the device, the movable parts are in contact with a medium believed to be clean, thus conferring on the device a longer lifetime than the lifetimes of the devices normally used in the prior art.

The energy required for the sequential blocking function of the orifices allowing the drive fluid to pass is low.

By using a fluid bearing between the parts that rotate with respect to each other, it is possible to cut down on wear occurring at the axis of rotation of the movable part.

Figure 2:
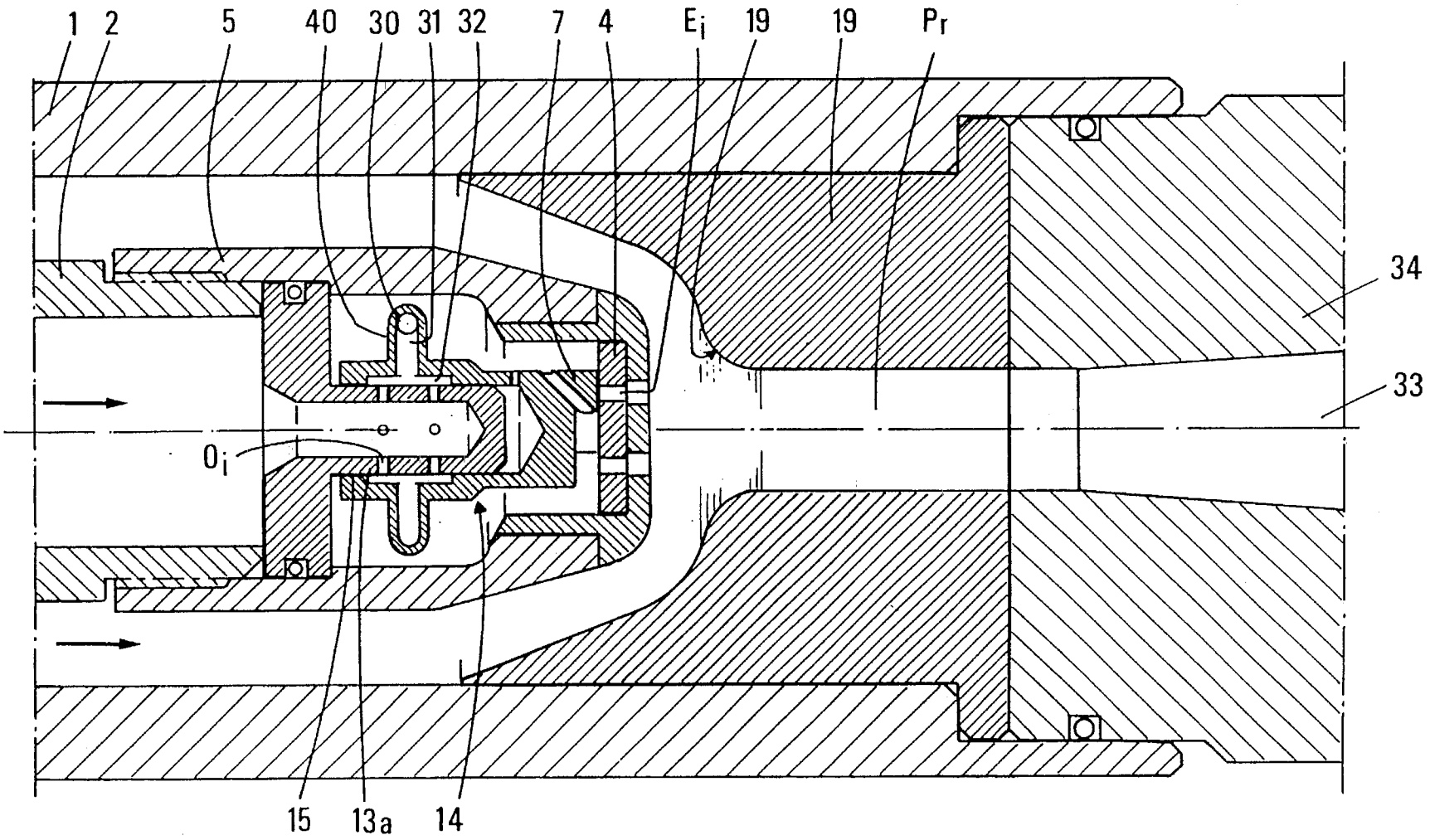
Figure 3:
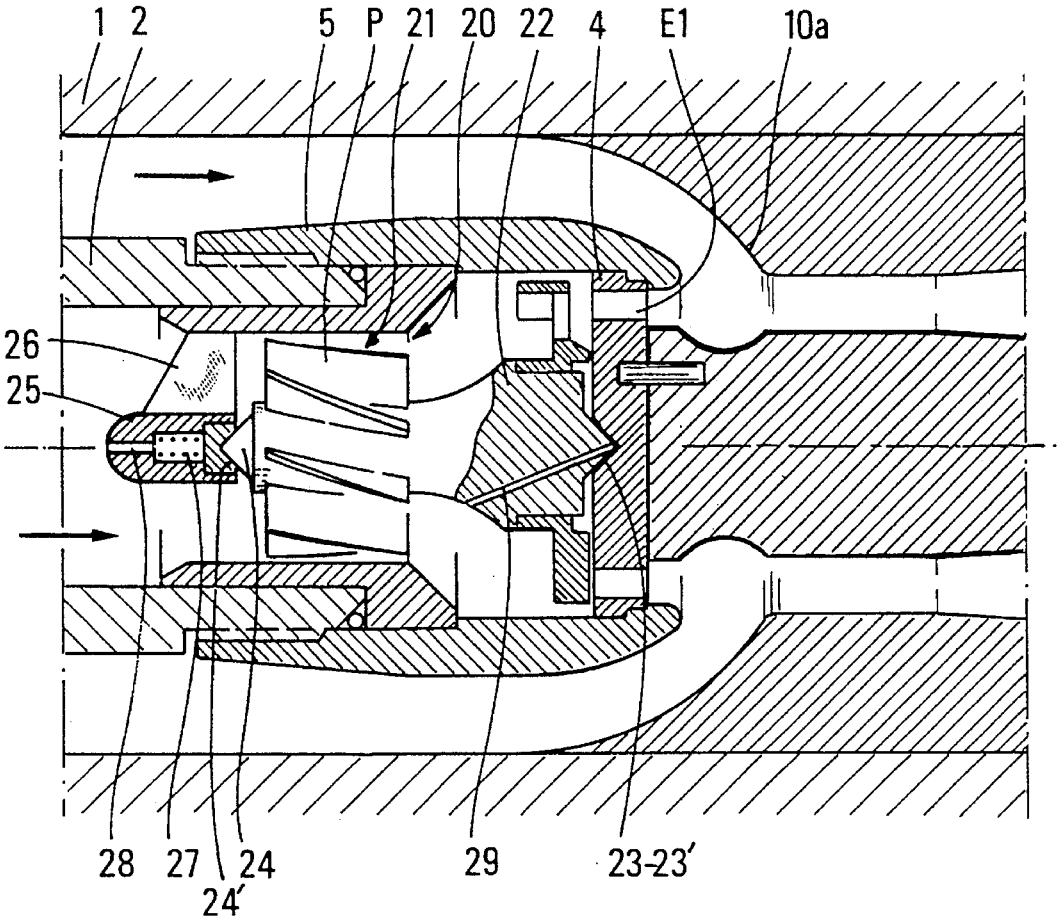
Figure 4:
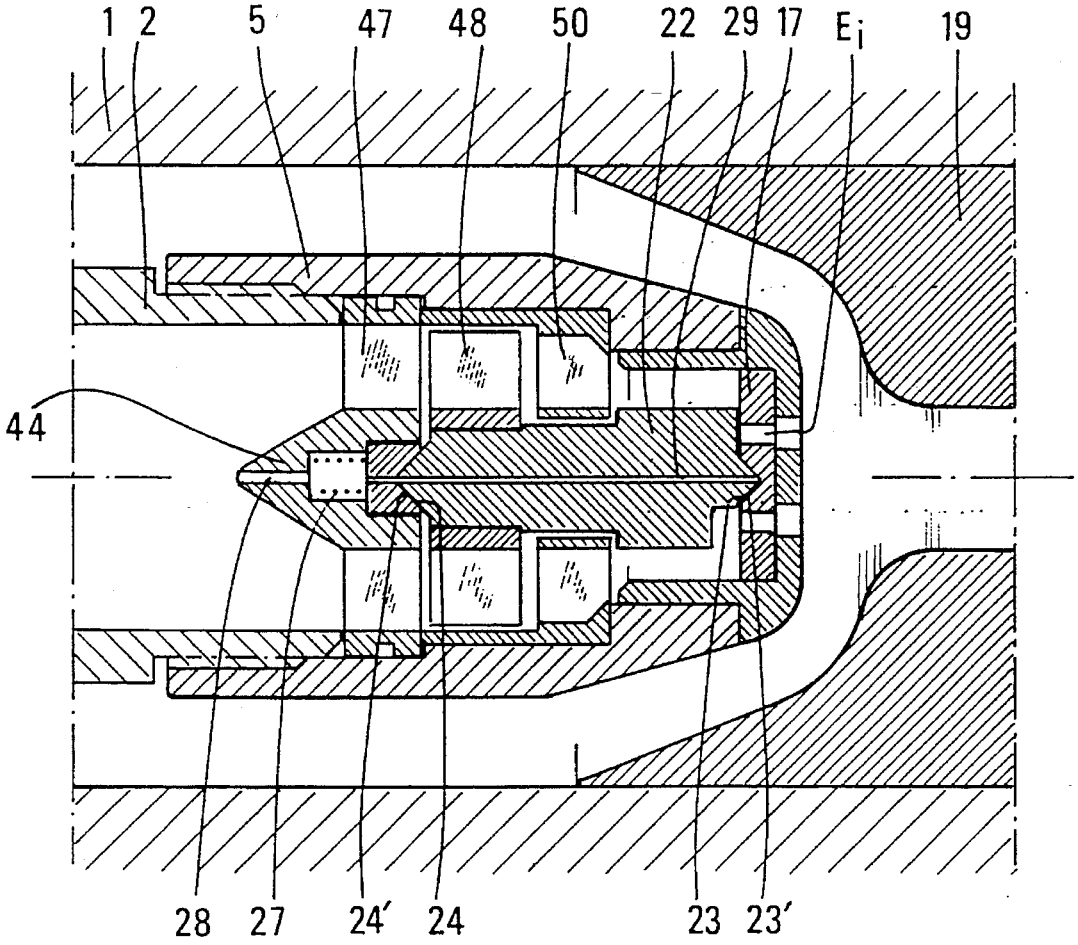

The present invention will be better understood and its advantages will emerge clearly by reading several nonlimiting examples illustrated by the following figures among which:

FIG. 1 shows schematically one example of the device according to the invention comprising a turbine brought into contact only with a particle-free fluid, FIG. 2 shows a variant of the device in FIG. 1 having a reaction turbine, and FIGS. 3 and 4 show variants of the device in which the contact surfaces between the rotating parts are minimized.

The embodiments of the device described in relation to FIGS. 1 to 4 relate to a number of variants of a device for pumping a fluid, for example a multiphase fluid containing impurities or primary fluid, to which at least part of the energy of a drive fluid is transferred directly.

The fluid to be pumped or primary fluid can be an effluent of the petroleum type containing several phases and particular impurities such as solid particles, hydrates, or sand.

The pumping device according to FIG. 1 is inserted for example into a pipe 1 in which the primary fluid, coming for example from an oil well not shown in the figure, circulates.

It has a static hollow part 2 which communicates with a source of pressurized drive fluid such as a pressurized liquid not shown. One of the ends of part 2 is T-shaped for example, comprising successively a part 3*a*, an end 3*b*, and another part 3*c*. Parts 3*a* and 3*c* have for example orifices Oi which allow the drive liquid to pass inside static hollow part 2 to a distributing part 4 which has for example several orifices or openings Ei. Distributing part 4 is located substantially in the axis of static hollow part 2 and held by a connecting part 5. Connecting part 5 also provides a seal between the various parts so that the primary fluid containing impurities flows solely or practically totally in pipe 1. This prevents primary fluid from entering the space formed by static hollow part 2, distributing part 4, and connecting part 5, thus preventing contact between impurities and the movable parts of the device described below. A movable part 6 such as a turbine is positioned between static hollow part 2 and distributing part 4; in this way it is only in contact with the drive liquid due to the seal provided by connecting part 5 and hence with an impurity-free liquid or liquid containing only a tiny proportion of impurities. The turbine is for example rotationally movable about part 3*b* of part 2 via bearings 8. The turbine can be fitted with blades P serving to support at least one means for blocking orifices Ei such as a slide 7. When thee turbine rotates under the action of the drive fluid, slide 7 blocks orifices Ei, which generates jets of drive fluid, or fluid or liquid "pistons," which encounter the primary fluid to be pumped and propel it, communicating thereto at least part of the energy they possess.

The blocking of orifices Ei is for example sequential, the orifices being blocked one after the other, and the encounter with the primary fluid and liquid pistons occurring for example after orifices Ei.

The mixture of liquid pistons and primary fluid formed is then transferred for example to a treatment station via a transfer pipe or to an extension pipe.

The speeds of the primary fluid and the liquid pistons are such that the probability of primary fluid returning through orifices Ei to the space in which the movable part is located is minimized. In this way, it is practically impossible for impurities to encounter the rotating turbine. The flowrate of a liquid piston is for example far higher than the flowrate of the primary fluid, being for example approximately 100 m/s.

Advantageously, orifices Oi are inclined to favor mixing of the liquid piston and primary fluid.

The turbine with the slide can be made to rotate by a device not shown which allows the rotational speed to be varied.

The rotational speed is chosen for example according to the desired frequency of sending fluid pistons or liquid pistons formed by the passage of the drive liquid jets through orifices Ei.

The geometry of orifices Ei, namely their shapes and sizes, establishes for example the ratio between the active length of the liquid piston injected and the total length or total duration of the piston production cycle.

In order to improve energy transfer between a liquid piston coming from an orifice Ei and the primary fluid, it is possible to place, in the extension of distributing part 4, a part 9 designed to create and delimit at least one channel 12*i* in which the mixing of the primary fluid and liquid piston is total. A channel 12*i* has for example a first part and a second part that have lengths Z1 and Z2, respectively. The first part has an essentially constant cross section over the majority of its length Z1 and the second part or diffuser has a section that tapers in the direction away from the point at which the two fluids enter the channel, over at least a majority of its length Z2. Part 9 is for example positioned relative to distributing part 4 with the aid of an alignment finger known to the individual skilled in the art. Channels 12*i* in particular guide the encounter of a liquid piston with at least part of the primary fluid, and favor their encounter and mixing. The presence of the diffuser allows the speed energy acquired in mixing channel 12*i* to become converted into pressure energy. Part 9 also has orifices Ai whose number is for example equal to that of orifices Ei, which allow jets coming from channels 12*i* to be transferred to a transfer pipe.

The inside wall of part 9 may have a part 10, the inside wall of which has a first incurved zone 10*a* followed by a second zone 10*b* with for example a length Z1 extended by a third zone 10*c* substantially at an angle to the axis of the pipe which has a length Z2 for example, a central part 11, for example cylindrical or slightly conical, having incurved zones 11*a* located opposite incurved zones 10*a* thus forming a space in which a liquid piston encounters a primary fluid, the space being located downstream from orifices Ei. The first zone 11*a* of part 11 is extended for example by a second zone 11*b* whose length is substantially identical to length Z1 and a third zone 11*c* extending second zone 11*b* and having a length substantially equal to length Z2.

The central part of part 9 may be extended by a pact 9*b* such as a nose penetrating into the transfer pipe located for example in the extension of channel 1 so that passage of the fluid mixture from the channels to the transfer pipe occurs without generating disturbances in the flows.

The aperture angle obtained at the outlet of mixing channel 12*i* as defined above is for example equal to 7°.

Another possibility is to replace the various orifices by a single circular slot in order to create a single annular mixing space instead of the channels described above. Central part 9 is then rendered integral with distributing part 4.

According to one advantageous embodiment of the device (FIG. 2), a reaction turbine is used as the moving part.

Static hollow part 2 of the device is extended at one end by a part 13*a* having at least one orifice Oi, the diameter of part 13*a* being less than that of part 2. Part 13*a* serves for example as an axis of rotation for a reaction turbine 14, which can be moved by bearings 15 such as fluid bearings which minimize friction and wear of parts 13*a* and 14.

Reaction turbine 14 has for example at one of its ends a slide 7 which, identically to that described in relation to FIG. 1, blocks orifices Ei of a distributing part 17 located substantially coaxially with respect to static hollow part 2, and maintained with respect to the latter by means of a connecting part 5 which also ensures a seal between parts 2, 17 in order to prevent primary fluid, which might contain impurities, from contacting turbine 14.

The device is positioned in pipe 1 such that the part containing distributing part 17 penetrates at least partially into a part 19 whose inside wall 19' is designed to create a passage Pr with a smaller cross section than that of pipe 1. This decrease in cross section creates a suction effect which favors mixing and transfer of energy from the liquid pistons to the primary fluid before its transfer to a divergent section 33 formed by a part 34 located downstream of part 19. The role of the divergent part is in particular to allow speed energy then to be converted into pressure energy.

The liquid pistons are generated according to a principle substantially identical to that described in relation to FIG. 1.

The drive liquid passes from inside static hollow part 2 thorough orifices Oi into an annular chamber 32, then leaves via orifices 30 through channels 31. The drive liquid has sufficient power for its passage through orifices 30 to generate a drive torque which in particular causes rotation of reaction turbine 14.

To minimize friction of the slide on the distributing part or plate containing the orifices and to decrease the energy picked up that is necessary to cause the slide to rotate, it is possible to minimize the contact surfaces existing between the rotational axis of the turbine and the other parts. Direct friction between the blocking slide and the distributing plate is eliminated by using an axial pivot which may have a means for taking up the play, said pivot being self-lubricating for example.

FIGS. 3 and 4 described hereinabove show schematically the variants of the devices described above.

FIG. 3 represents a variant of the device differing from FIG. 1 particularly by the shape of static part 2, especially its end, and the shape of movable part 6.

Static part 2 is open for example at both ends; the T-shaped part of FIG. 1 is replaced by an opening 20 into which is inserted an assembly comprising in particular a turbine 21 similar for example to that of FIG. 1. A turbine of the "paddlewheel" type normally used for flowmeter measurements made on fluids known as "clean fluids" such as particle-free fluids can be used. The assembly is positioned in the space formed by static part 2, connecting and sealing part 5, and distributing plate 4 (FIG. 1).

This assembly has for example turbine 21 comprising a part 22 terminating at each of its ends in tips, 23 and 24, respectively. Tip 23 fits into a space 23' provided in distributing part 4 and part 24 into a space 24' of a part 25 integral for example with static hollow part 2 through means 26 such as holding arms. The number of holding arms is three for example so that the drive fluid passing into static hollow part 2 circulates as freely as possible. The axis of turbine 20 is located for example substantially in the axis of the distributing part. The presence of tips allowing holding and rotation of the turbine reduces the torques and friction between parts.

Part 25 has for example a return means 27 such as a spring to take up any play resulting from wear of the tips over time.

In order to cut down considerably on friction between the various parts, a pipe 28 passes through part 25 for example and allows at least a fraction of the drive fluid coming from inside hollow part 2 to pass through, said fluid fraction thus forming a lubricating film between tip 24 and its accommodation 24'. The same applies to tip 23 which can be lubricated by forming a film over its surface obtained by passage of at least one part of the drive fluid through a pipe 29.

Turbine 21 has a series of blades P, each of which is preferably at an angle to the turbine axis. Identically to FIG. 1, the turbine is provided at least with a means allowing blocking of orifices Ei of distributing part 4, such as a slide 7, positioned relative to part 4 in such a way as to minimize the play between the distributing part and the slide. The small existing space thus allows the fraction of drive fluid to pass, thus ensuring lubrication of the two parts and cutting down friction.

The turbine is made to rotate in a manner identical to that described in FIG. 1, for example.

According to one advantageous embodiment shown schematically in FIG. 4, reaction turbine 14 and the associated slide of FIG. 2 are replaced by an assembly minimizing the friction forces, designed on a principle identical to that described in FIG. 3, namely having a shape that minimizes the contact surfaces between parts.

To optimize passage of the drive fluid through orifices Ei of the distributing part, the turbine can have a static blade controller 50 whose particular function is advantageously to transform the drive fluid into coaxial flow.

The drive fluid from the static hollow part strikes blades 48 of a turbine positioned around part 22 and causes it to rotate. The rotational speed of the turbine is chosen for example as a function of the attack and trailing angles of blades 48. After passage in controller 50, the drive fluid has a direction substantially coaxial with respect to the turbine axis and is thus in the form of a flow substantially coaxial with respect to orifices Ei. Any impacts between the fluid and the walls of the orifices and/or of the distributing part are thus minimized, and transfer of drive fluid in the form of jets to the primary fluid to be pumped is thereby optimized.

In this embodiment, pipe 29 (FIG. 3) can be situated according to the axis of part 22, for example over the entire length of this part, and can be in communication with pipe 28.

The drive fluid is for example a pressurized liquid coming from an external source.

According to one advantageous embodiment of the invention, the drive fluid is for example a fluid miscible with the fluid to be pumped. For a pumped fluid with a high viscosity, such mixing allows this viscosity to be decreased, favoring pumping and transport of such a fluid over long distances.

The fluid can also include products or additives such as rustproofers, inhibitors of hydrates allowing formation of deposits, and additives to counteract flocculation or precipitation of the fluids to be pumped.

These products are well known for example to experts in the oil industry.

Without departing from the framework of the invention, this fluid can also be oil or water coming for example from the field being produced.

It can also be sea water.

In both cases, the fluids are taken from a spring or the sea with a device not shown in the figures and conveyed to the static hollow part through a pipe. When such fluids are used, it is preferable to have, downstream of the orifices Oi allowing this water to pass to the movable part, a device allowing any particles contained in such water to be retained, such as a filter in normal use and of a size such as to retain any particles contained in the fluid.

For fluids from a spring at an inadequate pressure, it is possible to position a device raising the pressure of these fluids so that they can play the role of a drive fluid.

The shapes of the orifices of the distributing part are chosen according to the length of the desired liquid piston. Thus, these openings can be circular, elongate, or slot-shaped.

In order to stay at constant average motive power, each diameter of a nozzle is preferably apposed to a distributing part to preserve an instant flowrate of the drive liquid in the incoming drive fluid pipe.

The rotational speed of the sequential jet-creation device, namely the distributing part, is for example between 0 and 3000 revolutions per minute.

The number of jets of drive fluid is chosen such that it favors the efficiency of the device.

When the drive liquid is made to contact the slide, this favors formation of a fluid film under the slide which minimizes friction between the blocked-off section and the slide. In this way, the energy necessary for the sequential blocking function is low.

This contact force can also be reduced by using turbine blades that have an angle of inclination chosen relative to the direction of the drive fluid coming from inside the static hollow part.

In the case of reaction turbines, this consists of inclining the propulsive jets or counter-reaction blades.

The movable part such as the action turbine, reaction turbine, or any other type of turbine can be controlled by a device, not shown, that allows at least part of the drive fluid to be sent preferably directly to the orifices of the distributing part.

The devices described above in relation to the figures can be positioned at the end of a piece of coil tubing, a technique being used increasingly for production of vertical wells as well as for horizontal drains.

I claim:

1. A pumping device employing direct energy exchange between a drive fluid and a primary fluid circulating through a pipe, said pumping device being located within said pipe and comprising, in combination, a static hollow part allowing said drive fluid to pass into said pipe, said static hollow part having at at least one of its ends at least one first orifice, a distributing part having at least two second orifices, said distributing part being situated with respect to the static hollow part such as to allow the drive fluid to pass from the at least one first orifice to at least one second orifice and into the primary fluid, with the distributing part and the static hollow part being joined to each other by a connecting and sealing part, a common meeting space being defined by the distribution part, the connecting and sealing part and the pipe in which the primary fluid circulates wherein the primary fluid and the drive fluid meet, a movable part disposed in a space formed by the static hollow part, the distributing part, and the connecting and sealing part, said movable part having at least one means for blocking at least one of said second orifices such that at least part of said drive fluid is ejected into the primary fluid at said meeting space in the form of liquid pistons when the movable part rotates.

2. A device according to claim 1 wherein said movable part is a turbine made to rotate by passage of the drive fluid.

3. A device according to claim 2 wherein the number of first orifices located in the static hollow part is equal to the number of second orifices located in the distributing part.

4. A device according to claim 1 further comprising a part located in an extension of the distributing part and aligned with the distributing part with the aid of means for defining flow channels, the part located in the extension having at least one opening creating a mixing channel.

5. A device according to claim 1 wherein the movable part is an action turbine caused to rotate by passage of the drive fluid.

6. Device according to claim 1 characterized in that movable part is a reaction turbine caused to rotate by the drive fluid.

7. Device according to claim 1 characterized in that orifices of distributing part are composed of a single circular slot and blocking means of the slot are composed of a slide designed to allow passage of the drive fluid jets over a given width.

8. A device according to claim 3, wherein the distributing part is extended by a part which comprises an elongated portion that extends within said pipe to create one or more mixing channels for the drive fluid and the primary fluid.

9. A device according to claim 1 allowing energy to be communicated from a drive fluid to a primary fluid such as a multiphase fluid containing solid particles and/or a fluid having high viscosity wherein said primary fluid comprises a multiphase liquid containing solid particles and said drive fluid comprises a pressurized liquid, said multiphase liquid admixinq with said drive liquid within said pipe.

10. A device according to claim 1 wherein said primary fluid is a petroleum fluid and said pipe is connected to a source of said petroleum fluid and said drive fluid is a pressurized liquid coming from an external source.

11. Device according to claim 2 characterized in that the movable part is an action turbine caused to rotate by the drive fluid.

12. Device according to claim 2 characterized in that the movable part is a reaction turbine caused to rotate by the drive fluid.

* * * * *